US007731115B2

(12) United States Patent
Johnson et al.

(10) Patent No.: US 7,731,115 B2
(45) Date of Patent: Jun. 8, 2010

(54) AGITATION SYSTEM FOR BLOWING INSULATION MACHINE

(75) Inventors: Michael W. Johnson, Lithopolis, OH (US); Michael E. Evans, Granville, OH (US); Agustin Hernandez, Blacklick, OH (US); Robert J. O'Leary, Newark, OH (US); Christopher M. Relyea, Columbus, OH (US); Brian K. Linstedt, Ostrander, OH (US); Gregory J. Merz, Gahanna, OH (US); Jeffrey W. Servaites, Centerville, OH (US); Keith A. Grider, Columbus, OH (US)

(73) Assignee: Owens Corning Intellectual Capital, LLCDE (US)

( * ) Notice: Subject to any disclaimer, the term of this patent is extended or adjusted under 35 U.S.C. 154(b) by 812 days.

(21) Appl. No.: 11/581,659

(22) Filed: Oct. 16, 2006

(65) Prior Publication Data

US 2008/0087752 A1 Apr. 17, 2008

(51) Int. Cl.
*B02C 23/02* (2006.01)

(52) U.S. Cl. ..... 241/101.8; 241/186.2; 241/247

(58) Field of Classification Search ..... 241/101.8, 241/185.5, 186.2, 186.3, 244, 247, 248
See application file for complete search history.

(56) References Cited

U.S. PATENT DOCUMENTS

| | | | | |
|---|---|---|---|---|
| 313,251 | A | 3/1885 | Taylor | |
| 1,630,542 | A | 5/1927 | Shulz | |
| 1,718,507 | A | 6/1929 | Wenzel et al. | |
| 1,811,898 | A | 6/1931 | Schur et al. | |
| 1,828,490 | A * | 10/1931 | Clement | 241/69 |
| 1,975,406 | A * | 10/1934 | Reschke | 241/89.3 |
| 2,049,063 | A | 7/1936 | Hubbard | |
| 2,057,121 | A | 10/1936 | Trevellyan | |
| 2,057,122 | A | 10/1936 | Trevellyan | |
| 2,193,849 | A | 3/1940 | Whitfield | |

(Continued)

FOREIGN PATENT DOCUMENTS

| | | |
|---|---|---|
| DE | 3238492 | 4/1984 |

(Continued)

OTHER PUBLICATIONS

Operator's Manual for Unisul's Mini-Matic Insulation Blowing Maching, Mfg. by UNISUL, Winter Haven, FL, Publication: RTL 100-08/03, CT0000310-CT0000322, 13 pages.

(Continued)

*Primary Examiner*—Bena Miller
(74) *Attorney, Agent, or Firm*—James J. Dottavio; Jason S. Fokens

(57) ABSTRACT

A machine for distributing blowing insulation including a shredding chamber configured to shred and pick apart the blowing insulation. The shredding chamber includes a plurality of low speed shredders, an agitator and a discharge mechanism. The agitator is mounted for rotation and rotates toward the discharge mechanism. The discharge mechanism includes a side inlet configured to receive the blowing insulation from the agitator. A baffle is disposed between the agitator and the discharge mechanism. The baffle is configured to partially obstruct the side inlet of the discharge mechanism. The baffle allows finely shredded blowing insulation to enter the side inlet of the discharge mechanism and directs heavy clumps of blowing insulation past the side inlet of the discharge mechanism for eventual recycling into the low speed shredders.

6 Claims, 7 Drawing Sheets

U.S. PATENT DOCUMENTS

| | | | | | |
|---|---|---|---|---|---|
| 2,200,713 | A | | 5/1940 | Ericson et al. | |
| 2,235,542 | A | | 3/1941 | Wenzel | |
| 2,262,094 | A | | 11/1941 | Burt | |
| 2,273,962 | A | | 2/1942 | Hubbard | |
| 2,291,871 | A | | 8/1942 | Bokum et al. | |
| 2,308,197 | A | | 1/1943 | Meyer | |
| 2,311,773 | A | | 2/1943 | Patterson | |
| 2,355,358 | A | | 8/1944 | Anderson | |
| 2,404,678 | A | | 7/1946 | Erb | |
| 2,437,831 | A | | 3/1948 | Moore | |
| 2,532,318 | A | | 12/1950 | Mackey et al. | |
| 2,532,351 | A | | 12/1950 | Wedebrock | |
| 2,550,354 | A | | 4/1951 | Jacobsen | |
| 2,618,817 | A | | 11/1952 | Slayter | |
| 2,637,502 | A | * | 5/1953 | Bond | 241/194 |
| 2,721,767 | A | | 10/1955 | Kropp | |
| 2,754,995 | A | | 7/1956 | Switzer | |
| 2,794,454 | A | | 6/1957 | Moulthrop | |
| 2,869,793 | A | | 1/1959 | Montgomery | |
| 2,938,651 | A | | 5/1960 | Specht et al. | |
| 2,954,176 | A | * | 9/1960 | Cole | 241/186.3 |
| 2,957,633 | A | * | 10/1960 | Andreas | 241/57 |
| 2,964,896 | A | | 12/1960 | Finocchiaro | |
| 2,984,872 | A | | 5/1961 | France | |
| 2,989,252 | A | | 6/1961 | Babb | |
| 3,051,398 | A | | 8/1962 | Babb | |
| 3,076,659 | A | | 2/1963 | Kremer | |
| 3,093,328 | A | * | 6/1963 | Law | 241/55 |
| 3,175,866 | A | | 3/1965 | Nichol | |
| 3,201,007 | A | | 8/1965 | Transeau | |
| 3,231,105 | A | | 1/1966 | Easley | |
| 3,278,013 | A | | 10/1966 | Banks | |
| 3,314,732 | A | | 4/1967 | Hagan | |
| 3,399,931 | A | | 9/1968 | Vogt | |
| 3,403,942 | A | | 10/1968 | Farnworth | |
| 3,430,873 | A | * | 3/1969 | Wahl et al. | 241/55 |
| 3,485,345 | A | | 12/1969 | Deasy | |
| 3,512,345 | A | | 5/1970 | Smith | |
| 3,556,355 | A | | 1/1971 | Ruiz | |
| 3,591,444 | A | | 7/1971 | Hoppe et al. | |
| 3,703,970 | A | | 11/1972 | Benson | |
| 3,747,743 | A | | 7/1973 | Hoffman, Jr. | |
| 3,861,599 | A | | 1/1975 | Waggoner | |
| 3,869,337 | A | | 3/1975 | Hoppe et al. | |
| 3,887,141 | A | * | 6/1975 | Francis | 241/52 |
| 3,895,745 | A | | 7/1975 | Hook | |
| 3,952,757 | A | | 4/1976 | Huey | |
| 3,995,775 | A | | 12/1976 | Birkmeier et al. | |
| 4,059,205 | A | | 11/1977 | Heyl | |
| 4,129,338 | A | | 12/1978 | Mudgett | |
| 4,133,542 | A | | 1/1979 | Janian et al. | |
| 4,134,508 | A | | 1/1979 | Burdett, Jr. | |
| 4,155,486 | A | | 5/1979 | Brown | |
| 4,179,043 | A | | 12/1979 | Fischer | |
| 4,180,188 | A | | 12/1979 | Aonuma et al. | |
| 4,228,964 | A | * | 10/1980 | Brady | 241/186.3 |
| 4,236,654 | A | | 12/1980 | Mello | |
| 4,268,205 | A | | 5/1981 | Vacca et al. | |
| 4,273,296 | A | | 6/1981 | Hoshall | |
| 4,337,902 | A | | 7/1982 | Markham | |
| 4,344,580 | A | | 8/1982 | Hoshall et al. | |
| 4,346,140 | A | | 8/1982 | Carlson et al. | |
| 4,365,762 | A | | 12/1982 | Hoshall | |
| 4,381,082 | A | | 4/1983 | Elliott et al. | |
| 4,411,390 | A | | 10/1983 | Woten | |
| 4,465,239 | A | | 8/1984 | Woten | |
| 4,536,121 | A | | 8/1985 | Stewart et al. | |
| 4,537,333 | A | | 8/1985 | Bjerregaard | |
| 4,560,307 | A | | 12/1985 | Deitesfeld | |
| 4,585,239 | A | | 4/1986 | Nicholson | |
| 4,640,082 | A | | 2/1987 | Gill | |
| 4,695,501 | A | | 9/1987 | Robinson | |
| 4,716,712 | A | | 1/1988 | Gill | |
| 4,784,298 | A | | 11/1988 | Heep et al. | |
| 4,880,150 | A | | 11/1989 | Navin et al. | |
| 4,915,265 | A | | 4/1990 | Heep et al. | |
| 4,919,403 | A | | 4/1990 | Bartholomew | |
| 4,978,252 | A | | 12/1990 | Sperber | |
| 5,014,885 | A | | 5/1991 | Heep et al. | |
| 5,037,014 | A | | 8/1991 | Bliss | |
| 5,052,288 | A | | 10/1991 | Marquez et al. | |
| 5,129,554 | A | | 7/1992 | Futamura | |
| 5,156,499 | A | | 10/1992 | Miklich | |
| 5,166,236 | A | | 11/1992 | Alexander et al. | |
| 5,289,982 | A | | 3/1994 | Andersen | |
| 5,303,672 | A | | 4/1994 | Morris | |
| 5,323,819 | A | | 6/1994 | Shade | |
| 5,368,311 | A | | 11/1994 | Heyl | |
| 5,380,094 | A | | 1/1995 | Schmidt et al. | |
| 5,392,964 | A | | 2/1995 | Stapp et al. | |
| 5,405,231 | A | | 4/1995 | Kronberg | |
| 5,462,238 | A | * | 10/1995 | Smith et al. | 241/243 |
| 5,472,305 | A | | 12/1995 | Ikeda et al. | |
| 5,511,730 | A | | 4/1996 | Miller et al. | |
| 5,601,239 | A | | 2/1997 | Smith et al. | |
| 5,620,116 | A | | 4/1997 | Kluger et al. | |
| 5,624,742 | A | | 4/1997 | Babbitt et al. | |
| 5,639,033 | A | | 6/1997 | Miller et al. | |
| 5,642,601 | A | | 7/1997 | Thompson, Jr. et al. | |
| 5,647,696 | A | | 7/1997 | Sperber | |
| 5,683,810 | A | | 11/1997 | Babbitt et al. | |
| 5,819,991 | A | | 10/1998 | Kohn et al. | |
| 5,829,649 | A | | 11/1998 | Horton | |
| 5,860,232 | A | | 1/1999 | Nathenson et al. | |
| 5,860,606 | A | | 1/1999 | Tiedeman et al. | |
| 5,927,558 | A | | 7/1999 | Bruce | |
| 5,934,809 | A | | 8/1999 | Marbler | |
| 5,987,833 | A | | 11/1999 | Heffelfinger et al. | |
| 5,997,220 | A | | 12/1999 | Wormser | |
| 6,004,023 | A | | 12/1999 | Koyanagi et al. | |
| 6,036,060 | A | | 3/2000 | Munsch et al. | |
| 6,070,814 | A | | 6/2000 | Deitesfeld | |
| 6,074,795 | A | | 6/2000 | Watanabe et al. | |
| 6,109,488 | A | | 8/2000 | Horton | |
| 6,161,784 | A | | 12/2000 | Horton | |
| 6,209,724 | B1 | | 4/2001 | Miller | |
| 6,266,843 | B1 | | 7/2001 | Doman et al. | |
| 6,296,424 | B1 | | 10/2001 | Eckel et al. | |
| 6,312,207 | B1 | | 11/2001 | Rautiainen | |
| 6,503,026 | B1 | | 1/2003 | Mitchell | |
| 6,510,945 | B1 | | 1/2003 | Allwein et al. | |
| 6,648,022 | B2 | | 11/2003 | Pentz et al. | |
| 6,698,458 | B1 | | 3/2004 | Sollars | |
| 6,779,691 | B2 | | 8/2004 | Cheng | |
| 6,783,154 | B2 | | 8/2004 | Persson et al. | |
| 6,796,748 | B1 | | 9/2004 | Sperber | |
| 6,826,991 | B1 | | 12/2004 | Ramussen | |
| 7,284,715 | B2 | | 10/2007 | Dziesinski et al. | |
| 7,354,466 | B2 | | 4/2008 | Dunning et al. | |
| 2001/0036411 | A1 | | 11/2001 | Walker | |
| 2003/0075629 | A1 | | 4/2003 | Lucas | |
| 2003/0192589 | A1 | | 10/2003 | Jennings | |
| 2003/0215165 | A1 | | 11/2003 | Hogan et al. | |
| 2003/0234264 | A1 | | 12/2003 | Landau | |
| 2004/0124262 | A1 | | 7/2004 | Bowman et al. | |
| 2005/0006508 | A1 | | 1/2005 | Roberts | |
| 2005/0242221 | A1 | | 11/2005 | Rota | |
| 2006/0024456 | A1 | | 2/2006 | O'Leary et al. | |
| 2006/0024457 | A1 | | 2/2006 | O'Leary et al. | |
| 2006/0024458 | A1 | | 2/2006 | O'Leary et al. | |
| 2006/0231651 | A1 | | 10/2006 | Evans et al. | |

2007/0138211 A1 6/2007 O'Leary et al.
2008/0087751 A1 4/2008 Johnson et al.

FOREIGN PATENT DOCUMENTS

| | | |
|---|---|---|
| DE | 3240126 | 5/1984 |
| EP | 0265751 | 4/1988 |
| FR | 2350450 | 3/1979 |
| GB | 1418882 | 12/1975 |
| GB | 1574027 | 9/1980 |
| GB | 2 099 776 | 12/1982 |
| GB | 2124194 | 2/1984 |
| GB | 2156303 | 10/1985 |
| GB | 2212471 | 7/1989 |
| GB | 2276147 | 9/1994 |
| JP | 407088985 | 4/1995 |
| NL | 8 204 888 | 7/1984 |

OTHER PUBLICATIONS

Attic Protector Blow-In Fiber Glass, Johns Manville International-Insulation Group RIG 1718, Denver, CO, www.jm.com, 08/00-REV, CT0000122-CT0000124, 3 page.
The Cyclone Insulation Blowing Machine, Intec, Frederick, CO, info@inteccorp.com, (Exhibit S), 2 pages.
Blow-Matic 8, Abiff Manufacturing Corp., Denver, CO, www.fiberiffic.com, Copyright 2002-2004 Ark-Seal, LLC, CT0000550-CT0000552, 3 pages.
Tiger II, Hoshall Equipmant, Division of Industrial Gaskel, Inc., Oklahoma City, OK, TWX9108313292 Ind Gasket OKC, CT0000555-CT0000556, 2 pages.
The Force/3 Insulation Blower, Intec, Frederick, CO, http://www.inteccorp.com/Force3.htm-Apr. 14, 2009, OC002923-OC002925, 3 pages.
The Quantum Insulation Blower, Intec, Frederick, CO, http://www.inteccorp.com/Quantum.htm-Apr. 14, 2009, OC002930-OC002931, 2 pages.
The Wasp Insulation Blower, Intec, Frederick, CO, http://www.intec-corp.com/Wasp.com-May 18, 2005, CT0000352-CT0000354, 3 pages.
Krendl #425, Krendl Machining Company, Delphos, OH, www.krendlmachine.com, Copyright Jan. 2009, CT000357-CT000358, 2 pages.
Krendl #250A, Krendl Machining Company, Delphos, OH, www.krendlmachine.com, Copyright Apr. 2008, CT000359-CT000360, 2 pages.
The Force/1, Intec, Frederick, CO, www.inteccorp.com, D200-0200-00, KL REV Mar. 2004, CT0000008-CT0000055, 50 pages.
Insulation Blowers—Accul 9118, Insulation Machine Corp., Springfield, MA, Copyright 2006, http://accuone.com/accul_9118.html-Apr. 4, 2009, CT0000056-CT0000057, 2 pages.
AccuOne 9400, AccuOne Industries, Inc., Copyright 1998, http://www.accu1.com/A9400.html-Jul. 13, 2004, CT0000059, 1 page.
Krendl #325, Krendl Machining Company, Delphos, OH, www.krendlmachine.com, CT0000060, 1 page.
Krendl #450A, Krendl Machining Company, Delphos, OH, http://www.krendlmachine.com/products/450a.asp?PartNo=450A-Jul. 13, 2004, CT0000067-CT0000068, 2 pages.
Cocoon Insulation, Cocoon, Charlotte, NC, Copyright 2003 U.S. Green Fiber, LLC and Copright 2003 by Lowe's, CT0000071-CT0000076, 6 pages.
X-Floc Minifant M99, X-Floc GmbH, Renningen, Germany, Mar. 18, 2009, http://www.x-floc.com/en/machines/minifant-m99.html-Apr. 6, 2009, CT0000449-CT0000451, 3 pages.
X-Floc Zellofant M95, X-Floc GmbH, Renningen, Germany, Feb. 8, 2009, http://www.x-floc.com/en/machines/zellofant-m95.html-Apr. 13, 2009, CT0000107-CT0000112, 6 pages.
Isoblow Mini, Isocell Vertriebs G.M.B.H., Neumarkt Am Wallersee, Austria, www.isocell.at/home-page/blowing-technology/isoblow-mini.html-Apr. 4, 2009, CT0000436-CT0000438, 3 pages.
Meyer Series 700, "Reliable Hydraulic Power on the Industry's Mot Versatile Platform", Copyright 2007 Wm. W. Meyer & Sons, Inc., Libertyville, IL, www.meyerinsulation.com, CT0000602-CT0000603, 2 pages.
InsulMaxx 1000, Spray Insulation Components, Oklahoma City, OK, http://www.sprayinsulation.com/catalog.asp-Jan. 4, 2008, CT0000606-CT0000608, 3 pages.
Cocoon-Attic Insulation Blowing Machine, Exhibit II, 2 pages.
U.S. Appl. No. 10/899,909—Advisory Action, May 26, 2009.
U.S. Appl. No. 10/899,909—Response to Final, May 12, 2009.
U.S. Appl. No. 10/899,909—Final Rejection, Mar. 20, 2009.
U.S. Appl. No. 10/899,909—Rejection, Sep. 20, 2007.
U.S. Appl. No. 10/899,909—Rejection, Apr. 4, 2008.
U.S. Appl. No. 10/899,909—Rejection, Sep. 9, 2008.
U.S. Appl. No. 10/899,909—Rejection, Aug. 27, 2007.
U.S. Appl. No. 10/899,909—Response, Dec. 20, 2007.
U.S. Appl. No. 10/899,909—Reponse, May 16, 2008.
U.S. Appl. No. 10/899,909—Response, Jan. 7, 2009.
U.S. Appl. No. 10/899,909—Restriction, Jul. 31, 2007.
U.S. Appl. No. 11/024,093—3 month office action, Mar. 2, 2007.
U.S. Appl. No. 11/024,093—3 month office action, Jul. 12, 2007.
U.S. Appl. No. 11/024,093—3 month office action, Mar. 5, 2009.
U.S. Appl. No. 11/024,093—Advisory Action, Jan. 11, 2008.
U.S. Appl. No. 11/024,093—Final 3 month, Oct. 24, 2007.
U.S. Appl. No. 11/024,093—RCE, Jan. 22, 2008.
U.S. Appl. No. 11/024,093—Response, Jan. 24, 2007.
U.S. Appl. No. 11/024,093—Response, Jun. 4, 2007.
U.S. Appl. No. 11/024,093—Response, Oct. 12, 2007.
U.S. Appl. No. 11/024,093—Response, Dec. 20, 2007.
U.S. Appl. No. 11/024,093—Response, May 28, 2009.
U.S. Appl. No. 11/024,093—Restriction, Nov. 24, 2006.
U.S. Appl. No. 11/303,612—3 Month, Oct. 15, 2009.
U.S. Appl. No. 11/303,612—Final 3 Month, Apr. 30, 2009.
U.S. Appl. No. 11/452,554—3 Month Office Action, Apr. 8, 2008.
U.S. Appl. No. 11/452,554—Advisor Action, Feb. 6, 2009.
U.S. Appl. No. 11/452,554—Final 3 Month, Oct. 15, 2008.
U.S. Appl. No. 11/452,554—Final 3 Month, May 5, 2009.
U.S. Appl. No. 11/452,554—RCE, Mar. 11, 2009.
U.S. Appl. No. 11/452,554—Response, Jun. 4, 2008.
U.S. Appl. No. 11/452,554—Response After Final, Jan. 14, 2009.
U.S. Appl. No. 11/581,660—3 month office, May 28, 2009.
U.S. Appl. No. 11/581,661—3 Month, Apr. 3, 2008.
U.S. Appl. No. 11/581,661—3 Month, May 5, 2009.
U.S. Appl. No. 11/581,661—Advisory Action, Jan. 27, 2009.
U.S. Appl. No. 11/581,661—Final 3 Month, Dec. 3, 2008.
APSCO—Pneumatic Conveying: Dilute Phase Systems, Dense Phase Systems . . . .
Choosing a pneumatic conveying system . . . ; Powder Bulk Engineering; Steve Grant.
Nonaka-Yasuhiro, Japanese Trade-Journal, Article, Characteristics of Functional Chromium Plating and Its Application, , 1999.
PCT Search Report for PCT/US05/26256 dated Nov. 22, 2005.
PCT Search Report for PCT/US05/27124 dated Nov. 22, 2005.
U.S. Appl. No. 11/303,612—Response, Jan. 14, 2009.
U.S. Appl. No. 11/581,661—Response, Jul. 17, 2008.
U.S. Appl. No. 11/303,612—Response AF, Jun. 29, 2009.
U.S. Appl. No. 11/581,661—Response AF, Jan. 9, 2009.
U.S. Appl. No. 11/581,661—Response; RCE, Feb. 25, 2009.

* cited by examiner

AGITATION SYSTEM FOR BLOWING INSULATION MACHINE

RELATED APPLICATIONS

This patent application is related to the following U.S. Patent Applications: Ser. No. 11/581,661, filed Oct. 16, 2006, entitled "Entrance Chute for Blowing Insulation Machine" and Ser. No. 11/581,660, filed Oct. 16, 2006, entitled "Exit Valve for Blowing Insulation Machine".

TECHNICAL FIELD

This invention relates to loosefill insulation for insulating buildings. More particularly this invention relates to machines for distributing packaged loosefill insulation.

BACKGROUND OF THE INVENTION

In the insulation of buildings, a frequently used insulation product is loosefill insulation. In contrast to the unitary or monolithic structure of insulation batts or blankets, loosefill insulation is a multiplicity of discrete, individual tufts, cubes, flakes or nodules. Loosefill insulation is usually applied to buildings by blowing the insulation into an insulation cavity, such as a wall cavity or an attic of a building. Typically loosefill insulation is made of glass fibers although other mineral fibers, organic fibers, and cellulose fibers can be used.

Loosefill insulation, commonly referred to as blowing insulation, is typically compressed in packages for transport from an insulation manufacturing site to a building that is to be insulated. Typically the packages include compressed blowing insulation encapsulated in a bag. The bags are made of polypropylene or other suitable material. During the packaging of the blowing insulation, it is placed under compression for storage and transportation efficiencies. Typically, the blowing insulation is packaged with a compression ratio of at least about 10:1. The distribution of blowing insulation into an insulation cavity typically uses a blowing insulation distribution machine that feeds the blowing insulation pneumatically through a distribution hose. Blowing insulation distribution machines typically have a large chute or hopper for containing and feeding the blowing insulation after the package is opened and the blowing insulation is allowed to expand.

It would be advantageous if blowing insulation machines could be improved to make them easier to use.

SUMMARY OF THE INVENTION

The above objects as well as other objects not specifically enumerated are achieved by a machine for distributing blowing insulation. The machine includes a shredding chamber configured to shred and pick apart the blowing insulation. The shredding chamber includes a plurality of low speed shredders, an agitator and a discharge mechanism. The agitator is mounted for rotation and rotates toward the discharge mechanism. The discharge mechanism includes a side inlet configured to receive the blowing insulation from the agitator. A baffle is disposed between the agitator and the discharge mechanism. The baffle is configured to partially obstruct the side inlet of the discharge mechanism. The baffle allows finely shredded blowing insulation to enter the side inlet of the discharge mechanism and directs heavy clumps of blowing insulation past the side inlet of the discharge mechanism for eventual recycling into the low speed shredders.

According to this invention there is also provided a machine for distributing blowing insulation. The machine includes a shredding chamber configured to shred and pick apart the blowing insulation. The shredding chamber includes a plurality of shredders and an agitator. The plurality of shredders and the agitator are configured for rotation. The plurality of shredders and the agitator rotate at different speeds.

According to this invention there is also provided a machine for distributing blowing insulation. The machine includes a shredding chamber configured to shred and pick apart the blowing insulation. The shredding chamber includes a plurality of shredders and an agitator. The shredding chamber further includes a plurality of guide shells positioned partially around the plurality of shredders and the agitator. The plurality of shredders and the agitator seal against the plurality of guide shells and direct the blowing insulation in a downstream direction.

According to this invention there is also provided a machine for distributing blowing insulation. The machine includes a shredding chamber configured to shred and pick apart the blowing insulation. The shredding chamber includes a plurality of shredders. Each shredder has a plurality of paddle assemblies mounted for rotation on a shredder shaft. Each paddle assembly has a major axis extending along the length of the paddle assembly. The rotation of each of the paddle assemblies creates a vertical plane. The major axis of a paddle assembly is substantially perpendicular to the major axis of a paddle assembly which rotates in the same vertical plane on an adjacent shredder shaft.

According to this invention there is also provided a machine for distributing blowing insulation. The machine includes a shredding chamber configured to shred and pick apart the blowing insulation. The shredding chamber includes a plurality of shredders configured for rotation. Each shredder including a shredder shaft and a plurality of paddle assemblies. Each paddle assembly includes a plurality of paddles. The paddles are mounted to the shredder shaft at an angle.

According to this invention there is also provided a machine for distributing blowing insulation. The machine includes a shredding chamber configured to shred and pick apart the blowing insulation. The shredding chamber includes a plurality of shredders. Each shredder has a plurality of paddle assemblies mounted for rotation on a shredder shaft. The paddle assemblies have paddles. The paddles have a hardness within the range of 60 A to 70 A Durometer to better grip the blowing insulation and prevent jamming of the blowing insulation within the shredder.

According to this invention there is also provided a machine for distributing blowing insulation. The machine includes a shredding chamber configured to shred and pick apart the blowing insulation. The shredding chamber includes a plurality of shredders. Each shredder has a plurality of paddle assemblies mounted for rotation on a shredder shaft. The paddle assemblies have blades. The blades have paddles attached to the blades. The shredders are interchangeable.

Various objects and advantages of this invention will become apparent to those skilled in the art from the following detailed description of the preferred embodiment, when read in light of the accompanying drawings.

DETAILED DESCRIPTION OF THE INVENTION

Figure 1:
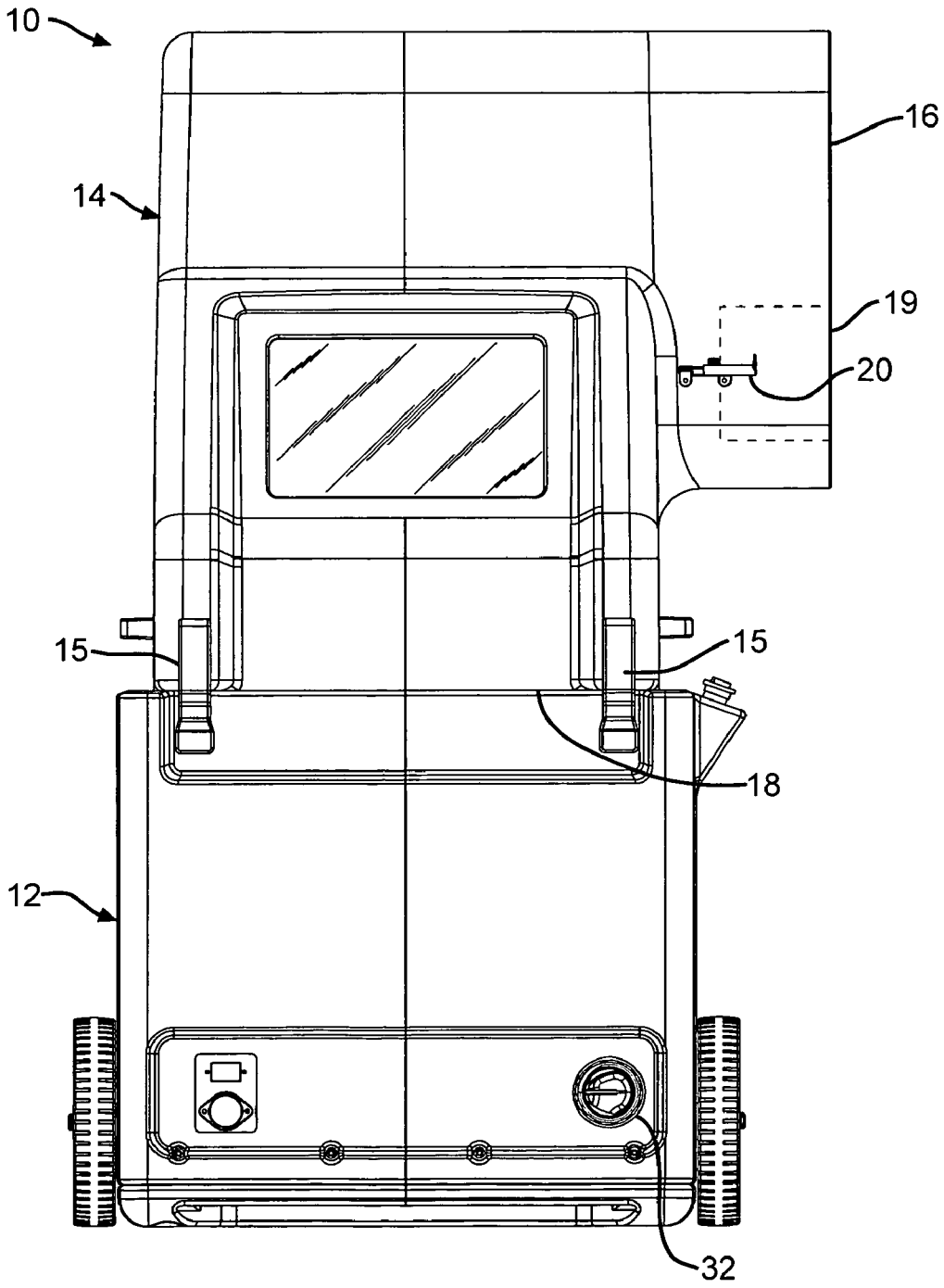
FIG. 1 is a front view in elevation of an insulation blowing insulation machine.
Figure 2:
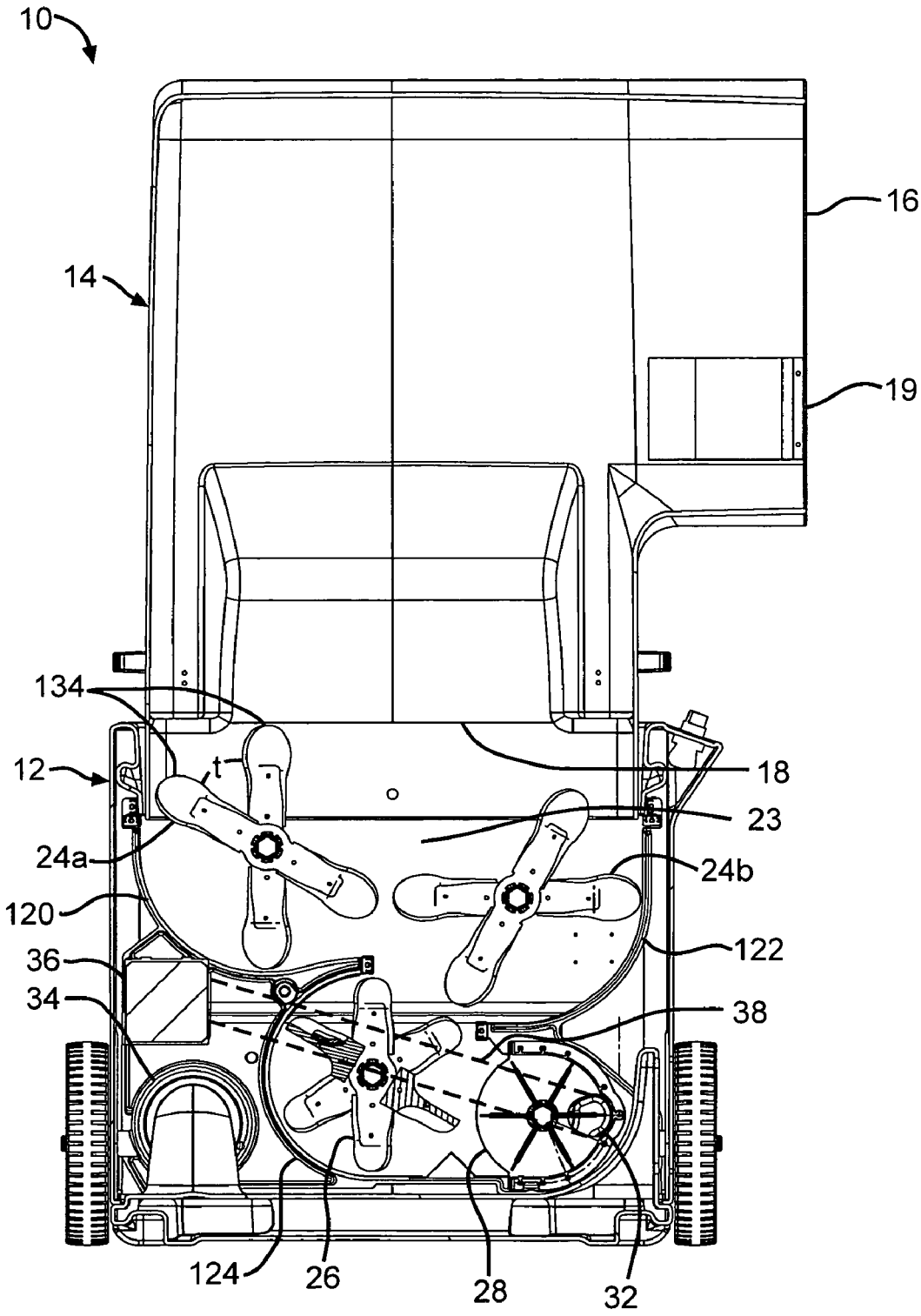
FIG. 2 is a front view in elevation, partially in cross-section, of the insulation blowing insulation machine of FIG. 1.
Figure 3:
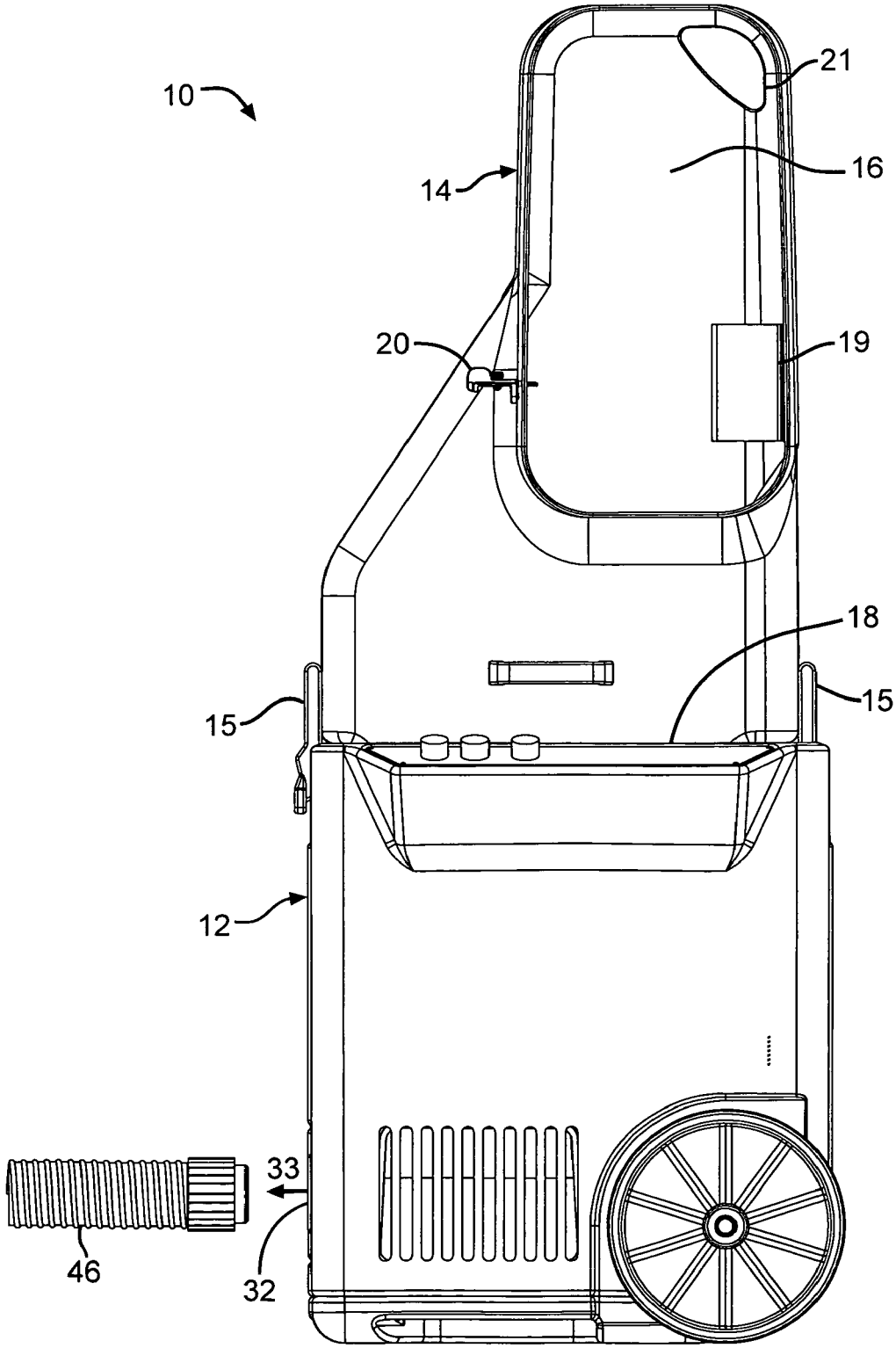
FIG. 3 is a side view in elevation of the insulation blowing insulation machine of FIG. 1.

A blowing insulation machine 10 for distributing blowing insulation is shown in FIGS. 1-3. The blowing insulation machine 10 includes a lower unit 12 and a chute 14. The lower unit 12 is connected to the chute 14 by a plurality of fastening mechanisms 15 configured to readily assemble and disassemble the chute 14 to the lower unit 12. As further shown in FIGS. 1-3, the chute 14 has an inlet end 16 and an outlet end 18.

The chute 14 is configured to receive the blowing insulation and introduce the blowing insulation to the shredding chamber 23 as shown in FIG. 2. Optionally, the chute 14 includes a handle segment 21, as shown in FIG. 3, to facilitate easy movement of the blowing insulation machine 10 from one location to another. However, the handle segment 21 is not necessary to the operation of the machine 10.

As further shown in FIGS. 1-3, the chute 14 includes an optional guide assembly 19 mounted at the inlet end 16 of the chute 14. The guide assembly 19 is configured to urge a package of compressed blowing insulation against a cutting mechanism 20, as shown in FIGS. 1 and 3, as the package moves into the chute 14.

As shown in FIG. 2, the shredding chamber 23 is mounted at the outlet end 18 of the chute 14. In this embodiment, the shredding chamber 23 includes a plurality of low speed shredders 24*a* and 24*b* and an agitator 26. The low speed shredders 24*a* and 24*b* shred and pick apart the blowing insulation as the blowing insulation is discharged from the outlet end 18 of the chute 14 into the lower unit 12. Although the blowing insulation machine 10 is shown with a plurality of low speed shredders 24, any type of separator, such as a clump breaker, beater bar or any other mechanism that shreds and picks apart the blowing insulation can be used.

As further shown in FIG. 2, the shredding chamber 23 includes an agitator 26 for final shredding of the blowing insulation and for preparing the blowing insulation for distribution into an airstream. In this embodiment as shown in FIG. 2, the agitator 26 is beneath the low speed shredders 24*a* and 24*b*. Alternatively, the agitator 26 can be disposed in any location relative to the low speed shredders 24*a* and 24*b*, such as horizontally adjacent to the shredders 24*a* and 24*b*, sufficient to receive the blowing insulation from the low speed shredders 24*a* and 24*b*. In this embodiment, the agitator 26 is a high speed shredder. Alternatively, any type of shredder can be used, such as a low speed shredder, clump breaker, beater bar or any other mechanism that finely shreds the blowing insulation and prepares the blowing insulation for distribution into an airstream.

In this embodiment, the low speed shredders 24*a* and 24*b* rotate at a lower speed than the agitator 26. The low speed shredders 24*a* and 24*b* rotate at a speed of about 40-80 rpm and the agitator 26 rotates at a speed of about 300-500 rpm. In another embodiment, the low speed shredders 24*a* and 24*b* can rotate at a speed less than or more than 40-80 rpm, provided the speed is sufficient to shred and pick apart the blowing insulation. The agitator 26 can rotate at a speed less than or more than 300-500 rpm provided the speed is sufficient to finely shred the blowing insulation and prepare the blowing insulation for distribution into the airstream 33.

Referring again to FIG. 2, a discharge mechanism 28 is positioned adjacent to the agitator 26 and is configured to distribute the finely shredded blowing insulation into the airstream. In this embodiment, the shredded blowing insulation is driven through the discharge mechanism 28 and through a machine outlet 32 by an airstream provided by a blower 36 mounted in the lower unit 12. The airstream is indicated by an arrow 33 as shown in FIG. 3. In another embodiment, the airstream 33 can be provided by another method, such as by a vacuum, sufficient to provide an airstream 33 driven through the discharge mechanism 28. In this embodiment, the blower 36 provides the airstream 33 to the discharge mechanism 28 through a duct 38, shown in phantom in FIG. 2 from the blower 36 to the rotary valve 28. Alternatively, the airstream 33 can be provided to the discharge mechanism 28 by another structure, such as a hose or pipe, sufficient to provide the discharge mechanism 28 with the airstream 33.

The shredders 24*a* and 24*b*, agitator 26, discharge mechanism 28 and the blower 36 are mounted for rotation. They can be driven by any suitable means, such as by a motor 34, or any other means sufficient to drive rotary equipment. Alternatively, each of the shredders 24*a* and 24*b*, agitator 26, discharge mechanism 28 and blower 36 can be provided with its own motor.

In operation, the chute 14 guides the blowing insulation to the shredding chamber 23. The shredding chamber 23 includes the low speed shredders 24*a* and 24*b* which shred and pick apart the blowing insulation. The shredded blowing insulation drops from the low speed shredders 24*a* and 24*b* into the agitator 26. The agitator 26 prepares the blowing insulation for distribution into the airstream 33 by further shredding the blowing insulation. The finely shredded blowing insulation exits the agitator 26 and enters the discharge mechanism 28 for distribution into the airstream 33 caused by the blower 36. The airstream 33, with the shredded blowing insulation, exits the machine 10 at the machine outlet 32 and flows through the distribution hose 46, as shown in FIG. 3, toward the insulation cavity, not shown.

Figure 4:
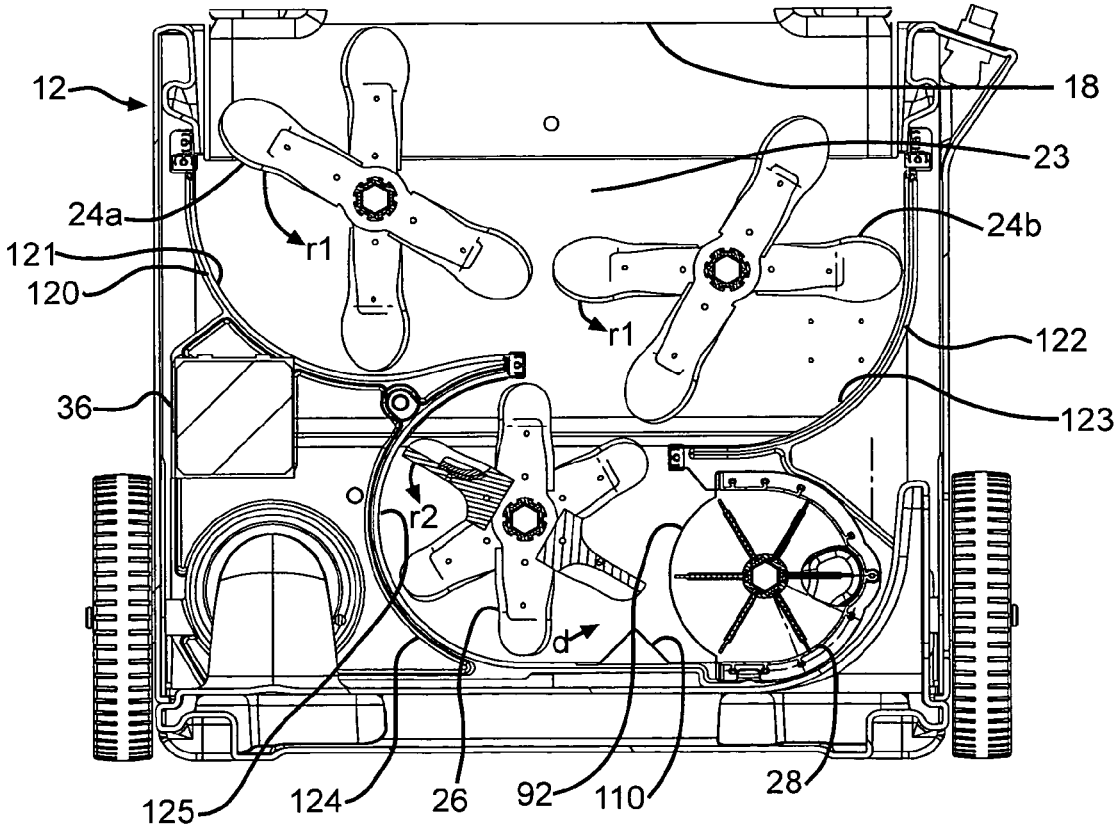
FIG. 4 is a front view, partially in cross-section, of the lower unit of the insulation blowing insulation machine of FIG. 1.

As previously discussed and as shown in FIG. 4, the discharge mechanism 28 is configured to distribute the finely shredded blowing insulation into the airstream 33. In this embodiment, the discharge mechanism 28 is a rotary valve. Alternatively, the discharge mechanism 28 can be any other mechanism including staging hoppers, metering devices, or rotary feeders, sufficient to distribute the shredded blowing insulation into the airstream 33.

In this embodiment as further shown in FIG. 4, the low speed shredders 24*a* and 24*b* rotate in a counter-clockwise direction r1 and the agitator 26 rotates in a counter-clockwise direction r2. Rotating the low speed shredders 24*a* and 24*b* and the agitator 26 in the same counter-clockwise direction allows the low speed shredders 24*a* and 24*b* and the agitator 26 to shred and pick apart the blowing insulation while substantially preventing an accumulation of unshredded or partially shredded blowing insulation in the shredding chamber 23. In another embodiment, the low speed shredders 24*a* and

24*b* and the agitator 26 each could rotate in a clock-wise direction or the low speed shredders 24*a* and 24*b* and the agitator 26 could rotate in different directions provided the relative rotational directions allow finely shredded blowing insulation to be fed into the discharge mechanism 28 while preventing a substantial accumulation of unshredded or partially shredded blowing insulation in the shredding chamber 23.

In this embodiment as shown FIG. 4, the shredding chamber 23 includes a plurality of guide shells 120, 122 and 124. The upper left guide shell 120 is positioned partially around the low speed shredder 24*a* and extends to form an arc of approximately 90°. The upper left guide shell 120 has an upper left guide shell inner surface 121. The upper left guide shell 120 is configured to allow the low speed shredder 24*a* to seal against the upper left guide shell surface 121 and thereby direct the blowing insulation in a downstream direction as the low speed shredder 24*a* rotates.

In a similar manner as the upper left guide shell 120, the upper right guide shell 122 is positioned partially around the low speed shredder 24*b* and extends to form an arc of approximately 90°. The upper right guide shell 122 has an upper right guide shell inner surface 123. The upper right guide shell 122 is configured to allow the low speed shredder 24*b* to seal against the upper right guide shell inner surface 123 and thereby direct the blowing insulation in a downstream direction as the low speed shredder 24*b* rotates.

In a manner similar to the upper guide shells 120 and 122, the lower guide shell 124 is positioned partially around the agitator 26 and extends to form an approximate semi-circle. The lower guide shell 124 has a lower guide shell inner surface 125. The lower guide shell 124 is configured to allow the agitator 26 to seal against the lower guide shell inner surface 125 and thereby direct the blowing insulation in a downstream direction as the agitator 26 rotates.

In this embodiment, the upper guide shell inner surfaces 121 and 123, and the lower guide shell inner surface 125 are made of high density polyethylene (hdpe) configured to provide a lightweight, low friction guide for the blowing insulation. Alternatively, the upper guide shell inner surfaces 121 and 123, and the lower guide shell inner surface 125 can be made of other materials, such as aluminum, sufficient to provide a sealing surface that allows the low speed shredders 24*a*, 24*b* or the agitator 26 to direct the blowing insulation downstream.

In this embodiment, the upper guide shells 120 and 122 are curved and extend to form an arc of approximately 90°. In another embodiment, the upper guide shells 120 and 122 may be curved and extend to form an arc which is more or less than 90°, such that the upper guide shells 120 and 122 are sufficient to allow the low speed shredders 24*a* and 24*b* to seal against the upper guide shell surfaces 121 and 123, thereby directing the blowing insulation in a downstream direction as the low speed shredders 24*a* and 24*b* rotate. Similarly in this embodiment, the lower guide shell 124 is curved and extends to form an approximate semi-circle. In another embodiment, the lower guide shell 124 may be curved and extend to form an arc which is more or less than a semi-circle, such that the lower guide shell 124 is sufficient to allow the agitator 26 to seal against the lower guide shell surface 125, thereby directing the blowing insulation in a downstream direction as the agitator 26 rotates.

Figure 5:
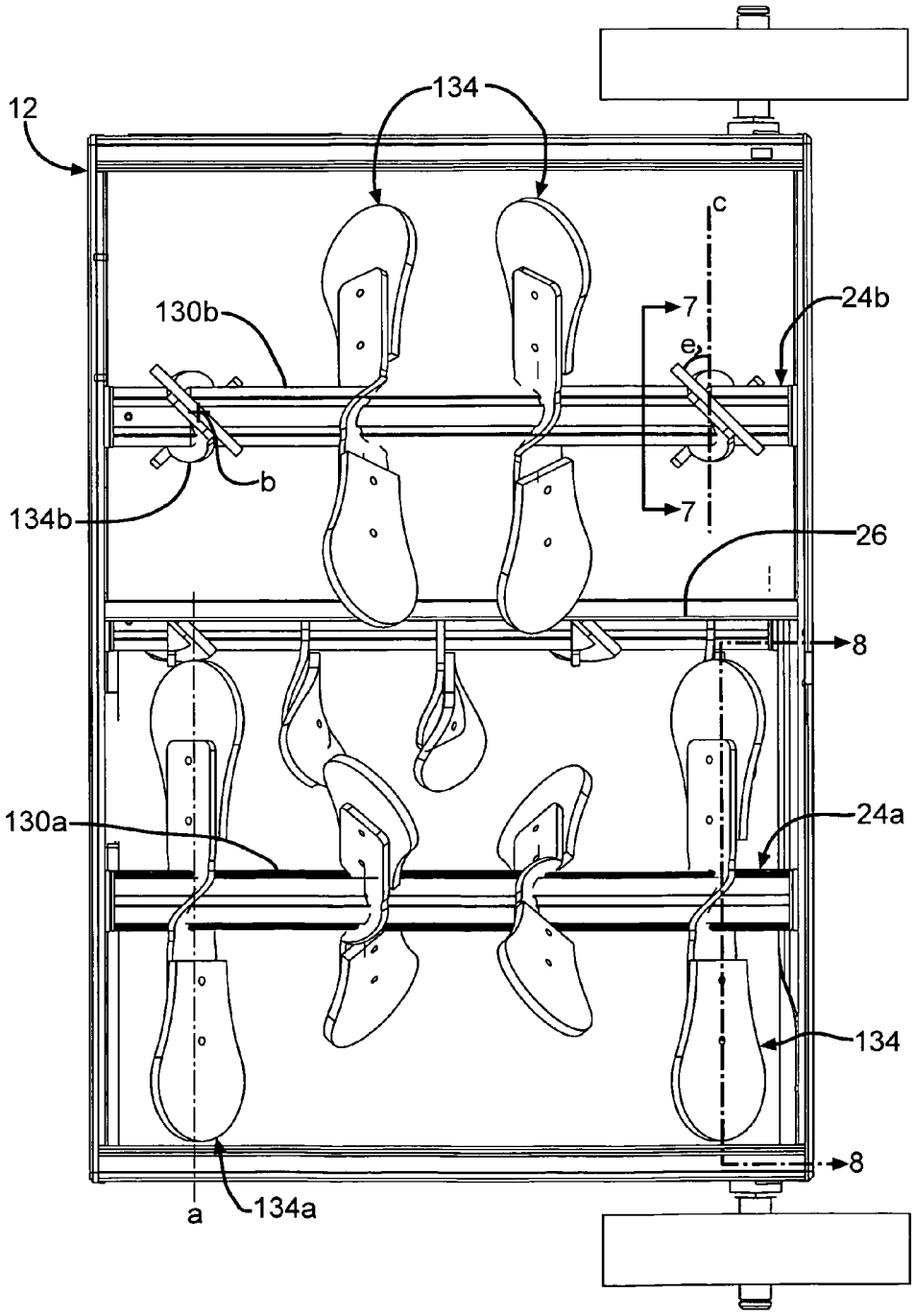
FIG. 5 is a plan view in elevation, of the shredding chamber of the insulation blowing insulation machine of FIG. 1.

As previously discussed and as shown in FIG. 2, the shredding chamber 23 includes a plurality of low speed shredders 24*a* and 24*b* and an agitator 26. As shown in FIG. 5, the low speed shredders 24*a* and 24*b* include adjacent, parallel shredder shafts 130*a* and 130*b*, respectively. The shredder shafts 130*a* and 130*b* are configured to rotate within the shredding chamber 23 and are fitted with a plurality of paddle assemblies 134. In this embodiment, the shredder shafts 130*a* and 130*b* are made of steel, although the shredder shafts 130*a* and 130*b* can be made of other materials, including aluminum or plastic, sufficient to rotate within the shredding chamber 23 and to be fitted with paddle assemblies 134. In this embodiment as shown in FIG. 5, the low speed shredders 24*a* and 24*b* each have four paddle assemblies 134 extending perpendicular from the shredder shafts 130*a* and 130*b*. In another embodiment, the low speed shredder shafts 130*a* and 130*b* each can have more than four paddle assemblies 134 or any number of paddle assemblies 134 sufficient to shred and pick apart the blowing insulation.

As further shown in FIG. 5, low speed shredder shaft 130*a* has a first paddle assembly 134*a* and low speed shredder shaft 130*b* has a second paddle assembly 134*b*. The first paddle assembly 134*a* has a major axis a extending along the length of the first paddles assembly 134*a*. Similarly, the second paddle assembly 134*b* has a major axis b extending along the length of the second paddle assembly 134*b*. In this embodiment, the major axis a of the first paddle assembly 134*a* is substantially perpendicular to the major axis b of the second paddle assembly 134*b*. The first paddle assembly 134*a* and the second paddle assembly 134*b* correspond to each other since they rotate in the same vertical plane. Similarly, the remaining paddle assemblies 134 disposed on the low speed shredder shaft 130*a* have major axis that are substantially perpendicularly positioned relative to the major axis of their corresponding paddle assemblies 134 disposed on the low speed shredder shaft 130*b*. The perpendicular alignment of the corresponding paddle assemblies 134*a* and 134*b* allows the low speed shredders 24*a* and 24*b* to effectively shred and pick apart the blowing insulation and prevent heavy clumps of blowing insulation from moving past the shredders 24*a* and 24*b* into the agitator 26 thereby preventing an accumulation of blowing insulation.

Figure 7:
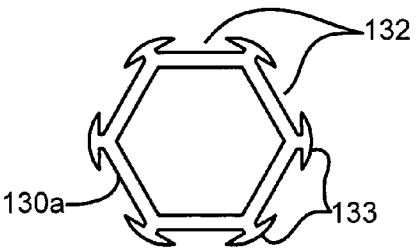
FIG. 7 is a front view in cross-section of the low speed shredder shaft of FIG. 5, taken along line 7-7.
Figure 8:
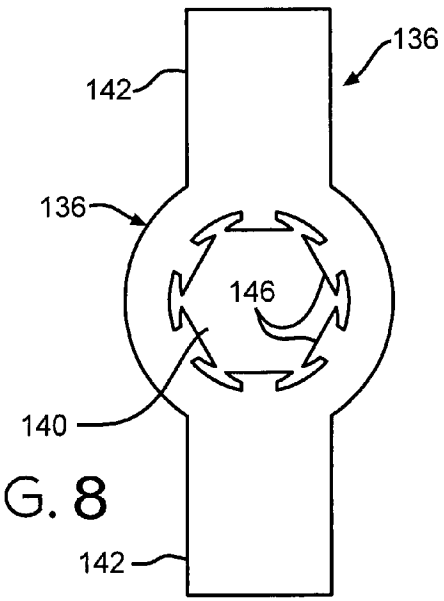
FIG. 8 is a front view in cross-section of the blade of the low speed shredder of FIG. 5, taken along line 8-8.
Figure 6:
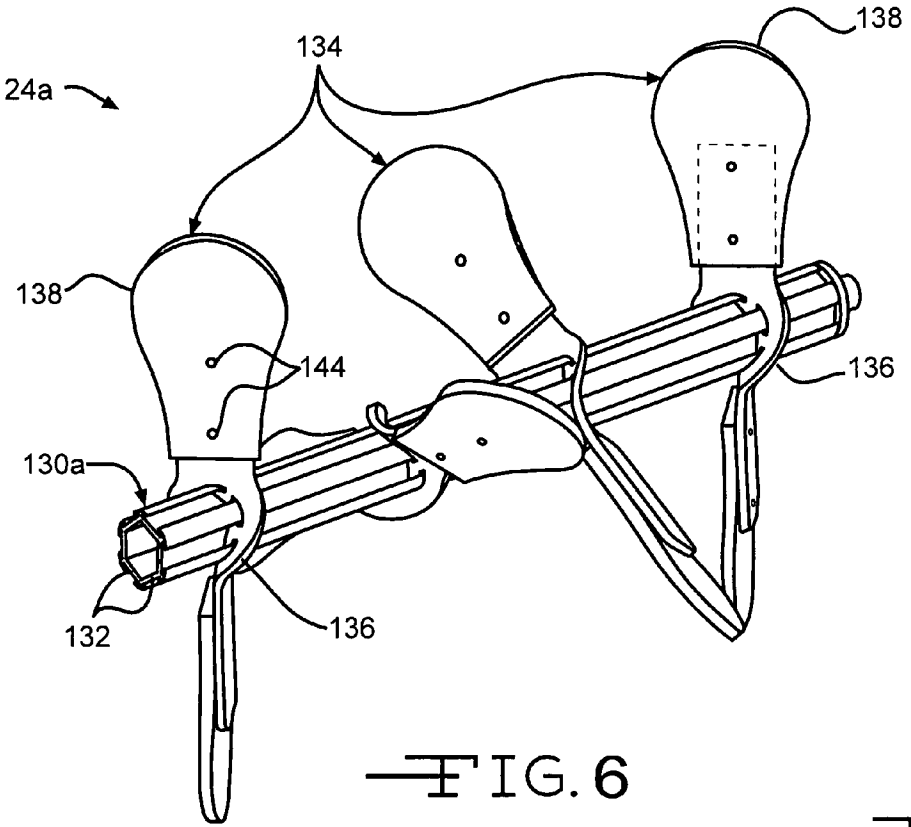
FIG. 6 is a perspective view of a low speed shredder of the insulation blowing insulation machine of FIG. 1.

As previously discussed and as shown in FIG. 6, the low speed shredders 24*a* and 24*b* include shredder shafts 130*a* and 130*b* and a plurality of paddle assemblies 134. As best shown in FIG. 7, the shredder shafts 130*a* and 130*b* are hollow rods having a plurality of flat faces 132 and alternate tangs 133 extending substantially along the length of the shredder shafts 130*a* and 130*b*. Referring again to FIG. 6, each paddle assembly 134 includes a blade 136 and two paddles 138. In this embodiment as shown in FIG. 8, the blade 136 is a flat member with a hole 140 and two mounting arms 142. The paddles 138 are fastened to the mounting arms 142 by rivets 144 as shown in FIG. 6. Alternatively, the paddles 138 can be fastened to the mounting arms 142 by other fastening methods including adhesive, clips, clamps, or by other fastening methods sufficient to attach the paddles 138 to the mounting arms 142. The blades 136 include T-shaped projections 146 positioned within the hole 140. In this embodiment as shown in FIG. 8, each paddle assembly 134 includes a blade 136 having two mounting arms 142 and paddles 138 attached to each mounting arm 142. In another embodiment, each paddle assembly 134 can include more or less than two mounting arms 142, each having a paddle 138 attached to the mounting arm 142, such that the paddle assemblies 134 effectively shred and pick apart the blowing insulation.

The blades 136 and the paddles 138 are mounted to the shredder shafts 130*a* and 130*b* by sliding the T-shaped projections 146 of the blades 136 onto the flat faces 132 of the shredder shafts 130*a* and 130*b*. The blades 136 and the paddles 138 positioned on the shredder shafts 130*a* and 130*b* have a major axis c which is substantially perpendicular to the shredder shafts 130*a* and 130*b* as shown in FIG. 5. Once the blades 136 and the paddles are positioned in the desired location along the shredder shafts 130*a* and 130*b*, the mounting arms 142 of the blades 136 are twisted, such that the T-shaped projections 146 of the blades 136 deform within the alternate tangs 133 of the shredder shafts 130*a* and 130*b* thereby locking the blades 136 and the paddles 138 in position.

As further shown in FIG. 5, the twisted blades 136 and paddles 138 are locked at angle e relative to the major axis c of the blades 136 and paddles 138. In this embodiment, angle e is approximately 40°-50°. By having angle e at approximately 40°-50°, the blades 136 and paddles 138 efficiently shred and pick apart the blowing insulation. While in this embodiment, the angle e is approximately 40°-50°, in another embodiment, the angle e may be more than 40°-50° or less than 40°-50° provided that the paddle assemblies 134 can efficiently shred and pick apart the blowing insulation.

As previously discussed and as shown in FIG. 5, the low speed shredders 24*a* and 24*b* include paddle assemblies 134, each paddle assembly having a plurality of paddles 138. In this embodiment, the paddles 138 are made of rubber and have a hardness rating of 60 A to 70 A Durometer. A hardness rating of between 60 A to 70 A allows the paddles 138 to effectively grip the blowing insulation for shredding while preventing jamming of the blowing insulation in the shredders 24*a* and 24*b*. Optionally, the paddles 138 can have a hardness greater than 70 A or less than 60 A. In another embodiment, the paddles 138 can be made of other materials, such as aluminum or plastic, sufficient to effectively grip the blowing insulation for shredding while preventing jamming of blowing insulation in the shredders 24*a* and 24*b*.

As further shown in FIG. 5, the low speed shredders 24*a* and 24*b* include a plurality of paddle assemblies 134 mounted to shredder shafts 130*a* and 130*b*. The plurality of paddle assemblies 134 are mounted on each shredder shaft 130*a* and 130*b* such that adjacent paddle assemblies 134 on the same shredder shaft 130*a* or 130*b* are offset from each other by an angle t as best shown in FIG. 2. Offsetting the paddle assemblies 134, from each other, on the shredder shafts 130*a* and 130*b* allows the paddle assemblies 134 to effectively grip the blowing insulation for shredding while preventing jamming of the blowing insulation in the shredders 24*a* and 24*b*. In this embodiment as shown in FIG. 2, the adjacent paddle assemblies 134 are offset by an angle t of approximately 60°. In another embodiment, the angle of offset can be any angle, such as an angle t within the range of from about 45° to about 90°, sufficient to effectively grip the blowing insulation for shredding while preventing jamming of the blowing insulation in the shredders 24*a* and 24*b*.

As discussed above and shown in FIG. 5, the low speed shredders 24*a* and 24*b* include a plurality of paddle assemblies 134 mounted to shredder shafts 130*a* and 130*b*. In this embodiment, the shredder shafts 130*a* and 130*b* are substantially physically identical. Similarly, the paddle assemblies 134 mounted to the shredder shafts 130*a* and 130*b* are substantially physically identical and mounted to the respective shredder shafts 130*a* and 130*b* in the same manner. The shredders 24*a* and 24*b* are assembled to be identical for ease of replacement. It is to be understood that the shredder shafts 130*a* and 130*b* can be different. Similarly, in another embodiment, the shredders 24*a* and 24*b* can be different.

Figure 9:
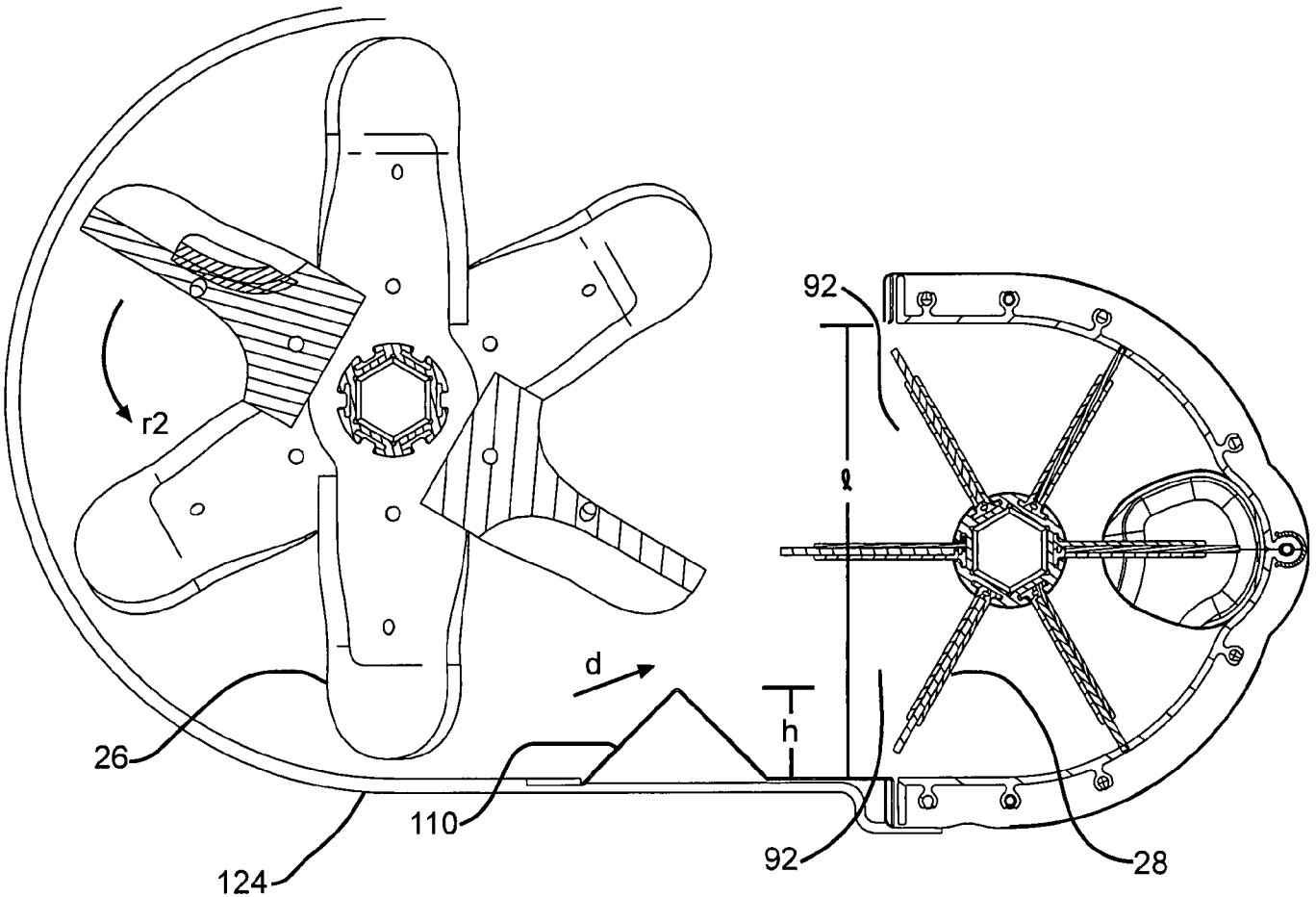
FIG. 9 is a front view in elevation of the agitator, side inlet and discharge mechanism of the insulation blowing machine of FIG. 1.

As previously discussed and as shown in FIGS. 4 and 9, the shredded blowing insulation exits the low speed shredders 24*a* and 24*b* and drops into the agitator 26 for final shredding. In this embodiment as best shown in FIG. 9, the agitator 26 rotates in a counter-clockwise direction r2 and forces the finely shredded blowing insulation in direction d toward a side inlet 92 of the discharge mechanism 28 for distribution into the airstream 33. A baffle 110 is positioned between the agitator 26 and the side inlet 92 of the discharge mechanism 28. The baffle 110 can be molded into the lower guide shell 124, or can be mounted to the lower unit 12 by any fastening method, including, screws, clamps, clips or any fastening method sufficient to mount the baffle 110 to the lower unit 12.

The baffle 110 is configured to partially obstruct the side inlet 92 of the discharge mechanism 28. By partially obstructing the side inlet 92 of the discharge mechanism 28, the baffle 110 allows finely shredded blowing insulation to enter the side inlet 92 of the discharge mechanism 28 and directs heavy clumps of blowing insulation upward past the side inlet 92 of the discharge mechanism 28 to the low speed shredders 24*a* and 24*b* for recycling and further shredding.

In this embodiment, the baffle 110 has a triangular cross-sectional shape. Alternatively, the baffle 110 can have any cross-sectional shape sufficient to allow finely shredded blowing insulation to enter the side inlet 92 of the discharge mechanism 28 and to direct heavy clumps of blowing insulation past the side inlet 92 of the discharge mechanism 28 to the low speed shredders 24*a* and 324*b* for recycling.

As further shown in FIG. 9, the baffle 110 has a height h which extends to partially obstruct the side inlet 92 of the discharge mechanism 28. In this embodiment, the height h of the baffle 110 extends approximately 20% of the length l of the side inlet 92. Alternatively, the height h of the baffle 110 can extend to any height sufficient to allow finely shredded blowing insulation to enter the side inlet 92 of the discharge mechanism 28 and to direct heavy clumps of blowing insulation past the side inlet 92 of the discharge mechanism 28 to the low speed shredders 24*a* and 24*b* for recycling.

Any type of blowing insulation may be used with the machine of the present invention. Typically, the loosefill blowing insulation is made of glass fibers although other insulation materials such as rock wool, mineral fibers, organic fibers, polymer fibers, inorganic material, and cellulose fibers. Other particulate matter, such as particles of foam, may also be used. Combinations of any of the aforementioned materials are another alternative.

Compressed bags of blowing insulation may be used with the blowing insulation machine of the present invention. Alternatively, blowing insulation may be removed from its packaging and fed into the machine.

The principle and mode of operation of this blowing insulation machine have been described in its preferred embodiments. However, it should be noted that the blowing insulation machine may be practiced otherwise than as specifically illustrated and described without departing from its scope.

What is claimed is:

1. A machine for distributing blowing wool from a bag of compressed blowing wool, the machine comprising:

a shredding chamber configured to shred and pick apart the blowing wool, the shredding chamber including a plurality of low speed shredders, an agitator and a discharge mechanism, the agitator mounted for rotation and rotating toward the discharge mechanism, the discharge mechanism including a side inlet, the side inlet configured to receive the blowing wool from the agitator;

a baffle disposed between the agitator and the discharge mechanism, the baffle configured to partially obstruct the side inlet of the discharge mechanism;

wherein the baffle allows finely shredded blowing wool to enter the side inlet of the discharge mechanism and directs heavy clumps of blowing wool past the side inlet of the discharge mechanism for eventual recycling into the low speed shredders.

2. The machine of claim 1 in which the baffle has an approximate triangular cross-sectional shape.

3. The machine of claim 1 in which side inlet of the discharge mechanism has a vertical length and the baffle has a height, wherein the height of the baffle extends to approximately 20% of the vertical length of the side inlet.

4. The machine of claim 1, wherein the baffle is positioned on a floor of the machine.

5. The machine of claim 1, wherein the baffle is molded into a guide shell positioned partially around the agitator.

6. The machine of claim 1, wherein the baffle is positioned substantially halfway between the agitator and the discharge mechanism.

* * * * *